US010553989B2

(12) United States Patent
Grimm et al.

(10) Patent No.: US 10,553,989 B2
(45) Date of Patent: Feb. 4, 2020

(54) CABLE GRIP FOR OVERMOLDED OR POTTED PLUGS

(71) Applicant: Amphenol-Tuchel Electronics GmbH, Heilbronn (DE)

(72) Inventors: Michael Grimm, Mosbach (DE); Dietmar Lorcher, Neuenstadt (DE)

(73) Assignee: Amphenol-Tuchel Electronics GmbH, Heilbronn (DE)

( * ) Notice: Subject to any disclaimer, the term of this patent is extended or adjusted under 35 U.S.C. 154(b) by 0 days.

(21) Appl. No.: 16/098,928

(22) PCT Filed: Apr. 28, 2017

(86) PCT No.: PCT/EP2017/060277
§ 371 (c)(1),
(2) Date: Nov. 5, 2018

(87) PCT Pub. No.: WO2017/191067
PCT Pub. Date: Nov. 9, 2017

(65) Prior Publication Data

US 2019/0097352 A1 Mar. 28, 2019

(30) Foreign Application Priority Data

May 4, 2016 (DE) ..... 10 2016 108 311

(51) Int. Cl.
*H01R 13/58* (2006.01)
*H01R 43/00* (2006.01)

(52) U.S. Cl.
CPC ..... *H01R 13/5808* (2013.01); *H01R 13/5845* (2013.01); *H01R 43/00* (2013.01)

(58) Field of Classification Search
CPC . H01R 13/5808; H01R 13/5845; H01R 43/00
USPC ..... 439/449
See application file for complete search history.

(56) References Cited

U.S. PATENT DOCUMENTS 2,035,345 A * 3/1936 Schaefer ..... H01R 24/20 439/447
2,226,610 A * 12/1940 Heyman ..... H01R 13/5808 439/448
3,154,359 A * 10/1964 Farber ..... H01R 13/28 439/144
3,195,098 A * 7/1965 Miller ..... H01R 24/40 174/75 C
3,315,211 A * 4/1967 Weeks, Jr. ..... H01R 24/28 439/599
3,422,281 A * 1/1969 Coston ..... H02G 15/103 174/105 R
3,624,591 A * 11/1971 Buberniak ..... H01R 13/502 279/50

(Continued)

FOREIGN PATENT DOCUMENTS

DE 10333568 A1 2/2004
IE 19939882 C1 5/2001

(Continued)

*Primary Examiner* — Abdullah A Riyami
*Assistant Examiner* — Vladimir Imas
(74) *Attorney, Agent, or Firm* — Blank Rome LLP

(57) ABSTRACT

The invention relates to a method for producing a cable grip (1) for a cable (30) that is to be attached to a plug (2), has a round cross-section and includes a cable sheath (31) having an outer circumference.

7 Claims, 2 Drawing Sheets

(56) References Cited

Figure 1:
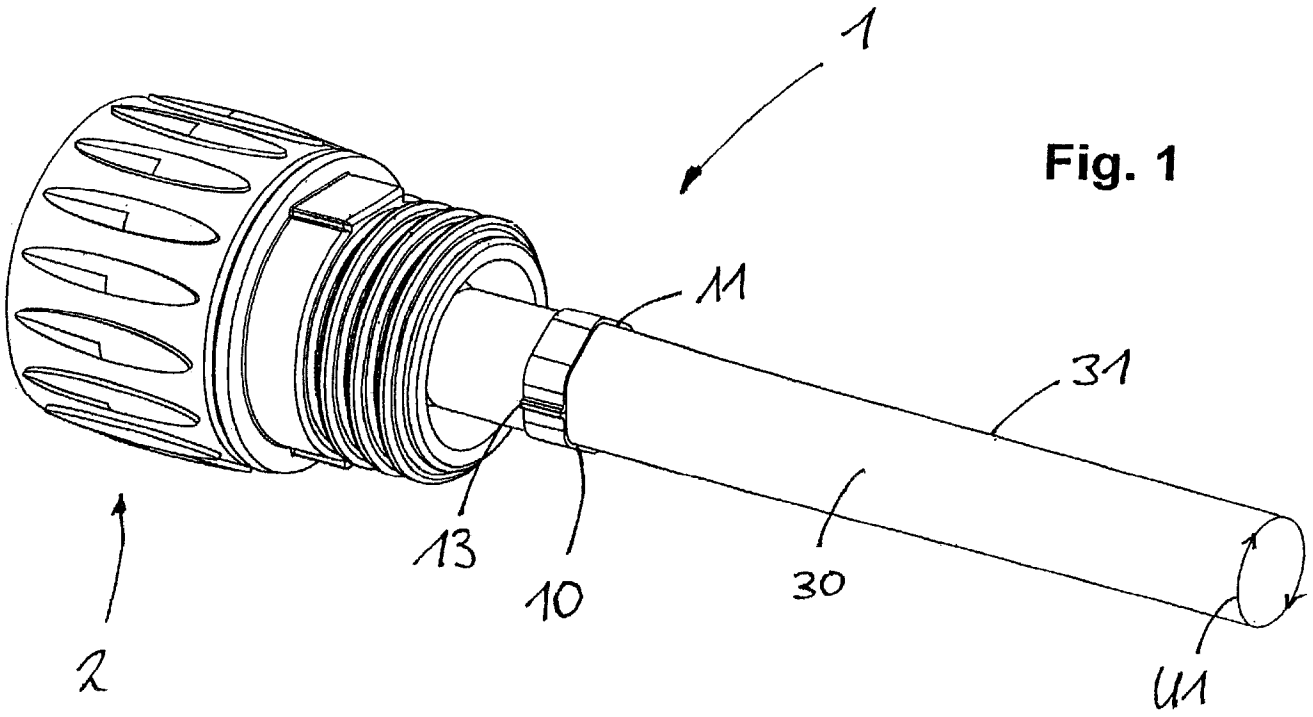

U.S. PATENT DOCUMENTS 4,211,463 A * 7/1980 Chandler ..... H01R 13/58 439/468
4,310,213 A * 1/1982 Fetterolf, Sr. ..... H01R 13/516 439/320
4,408,821 A * 10/1983 Forney, Jr. ..... H01R 9/05 439/387
4,615,574 A * 10/1986 Dearman ..... H01R 43/005 439/592
4,940,262 A * 7/1990 Baracat ..... H01R 13/58 285/114
4,990,103 A * 2/1991 Sazaki ..... H01R 13/506 439/445
6,149,455 A * 11/2000 Levi ..... H01R 13/59 439/321
6,257,920 B1 7/2001 Finona et al.
6,454,462 B2 * 9/2002 Nguyen ..... G02B 6/3817 385/53
6,793,520 B1 * 9/2004 Wu ..... H01R 13/5808 439/459
6,796,821 B2 * 9/2004 Cairns ..... G02B 6/4428 439/204
7,326,091 B2 * 2/2008 Nania ..... H01R 13/6271 439/681
7,744,402 B2 * 6/2010 Wu ..... H01R 12/592 439/455
7,955,121 B2 * 6/2011 Sattazahn ..... H01R 13/5808 439/455
8,083,540 B1 * 12/2011 Spicer ..... H02S 40/34 439/460
8,157,587 B2 * 4/2012 Paynter ..... H01R 4/5025 439/454
8,241,053 B2 * 8/2012 Slippy ..... H01R 13/5808 439/353
8,262,403 B2 * 9/2012 Slippy ..... H01R 13/5808 439/353
8,317,534 B2 * 11/2012 Osawa ..... H01R 13/6275 439/353
8,353,713 B2 * 1/2013 Hofer ..... H01R 13/187 439/181
8,357,007 B2 * 1/2013 Ihde ..... H01R 13/5808 439/455
8,545,256 B2 * 10/2013 Huffman ..... H01R 13/6335 439/277
8,597,053 B2 * 12/2013 Oh ..... H01R 13/5808 439/607.41
8,979,591 B2 * 3/2015 Mehnert ..... H01R 13/622 439/607.41
9,257,857 B2 * 2/2016 Lin ..... H02J 7/0042
9,461,401 B2 * 10/2016 Kao ..... H01R 13/5845
9,515,415 B1 * 12/2016 Lyon ..... H01R 13/5812
9,647,384 B2 * 5/2017 Rajpal ..... H01R 13/5812
9,954,337 B2 * 4/2018 Kao ..... H01R 13/5845

FOREIGN PATENT DOCUMENTS

WO 199815044 A1 4/1998
WO 2013022899 A1 2/2013
WO 2013105660 A1 7/2013

* cited by examiner

CABLE GRIP FOR OVERMOLDED OR POTTED PLUGS

RELATED APPLICATIONS

This application is a national stage application of International Application No. PCT/EP2017/060277, filed Apr. 28, 2017, which claims priority to German Patent Application No. 10 2016 108 311.9, filed May 4, 2016, the entire disclosures of which are hereby incorporated by reference.

The present invention relates to a cable grip and to an overmolded plug, which is prefabricated with a cable, with such a cable grip.

The prior art discloses that plugs are arranged at the end of a cable or a cable set. To this end, it is necessary for the plugs, consisting of connector and mating connector, to be provided with a cable grip in order to absorb the tensile or also compressive forces acting on the plug at the cable and consequently to relieve the contacts inside the plug of said acting forces, in particular in order to avoid or prevent faults and harmful effects.

It is known from electrical installation that a plug housing comprises a crossbar which can be screw-connected to the plug housing and is arranged over an end region of the cable and which, once screw-connected, exerts a compressive force onto the cable sheath.

A further solution that is popular in the prior art is the use of screw-connectable cable grip elements. A cable screw-connection acts, in this case, as a rule, such that an increasing compressive force acts on the cable by means of the screw-connection and, for example, the cable, in this case, is encompassed in a holding manner in a clamp cage.

It is usual when plugs are overmolded to produce the plug housing or part thereof using an injection molding/potting method, the region of the cable opening out directly being inserted into the injection/potting mold simultaneously with the injection molding/potting process and also being overmolded with the same material as the material of the plug housing.

A disadvantage, in this case, is that the finished plug housing is frequently not joined adequately to the material of the cable sheath as the requirements for the material of the plug housing are completely different requirements to the requirements made of the material of the cable sheath. As a result, it is possible to pull the cable out of the overmolded material in an unwanted manner.

The object underlying the invention, consequently, is to overcome the aforesaid disadvantages and to propose a solution to produce a simple, cost-efficient and universally usable cable grip for a plug.

Said object is achieved with an arrangement according to the features of claim 1.

A core concept of the present invention is to provide a specifically realized overmolding adapter sleeve which can be screw-connected to the plug housing and which at the same time comprises contours, by way of which sturdy overmolding around the overmolding adapter sleeve is able to be realized.

A core concept of the present invention consists in providing a plug with a cable grip or a method for this purpose where the cable grip is formed by a metal ring element which comprises a certain diameter and consequently also an internal circumference U2 which matches thereto.

The ring element, however, is deformed and reshaped from its original cross section to an effectively smaller cross section such that the "developed" internal circumference is smaller than the original internal circumference, as a result of which it is fixed on the cable sheath of the cable. The material, which has to be displaced for this purpose, is reshaped within the framework of a reshaping and bending process such that it results in material doubling and in element portions of the ring element which protrude radially outward.

Said portions, also designated below as ring element portions, serve for anchoring when the plug is overmolded, as will be described again subsequently.

Consequently, a method is proposed according to the invention for producing a cable grip of a cable which is to be attached to a plug and has a round cross section and has a cable sheath with an external circumference U1, said method having the following steps:

a) provide a metal ring element which is produced from a ring-shaped wall with a substantially circular cross section, wherein the ring element comprises an internal circumference U2 which is greater than the external circumference U1 of the cable sheath;

b) move the ring element onto the cable sheath of the cable at a defined position;

c) deform the ring element in such a manner that the reduced internal circumference, which is generated as a result of the deformation, is smaller than or equal to the external circumference U2 of the cable sheath such that it is fixed on the cable sheath and, in addition, the wall of the ring element has been reshaped in at least one region to reduce the original internal circumference U2 in such a manner that at least one ring element portion, which has been formed by the wall and reshaped, protrudes radially outward in relation to the cable sheath.

It is provided in a further advantageous embodiment of the invention that, in addition, the ring element has been reshaped as a result of the deformation in multiple regions to reduce the original internal circumference U2 such that the in each case deformed ring element portions protrude radially outward in relation to the cable sheath.

In this way, a kind of star-shaped manifestation of the ring element can be achieved with multiple ring element portions which protrude, i.e. project radially outward.

In a further advantageous design of the invention, it is provided that there is material doubling produced by wall portions of the wall of the ring element in the deformed ring element portions or that the ring element portions are formed from a doubling of material.

In a further advantageous embodiment of the invention, it is provided that a first wall portion bears flatly with its inside surface on the inside surface of the second wall portion in the region of the material doubling of the wall portions.

In other words, this means that reshaping the wall portion outward and reforming it results in the aforenamed material doubling.

It is also advantageous when the internal circumference U2 is greater by approximately between 15% and 40%, preferably approximately between 25% and 35% than the external circumference U1 of the cable sheath.

It is further advantageous when the ring element is cut off in the desired width B from a cylindrical tube material.

This is a particularly advantageous design as by means of a favorable, simple tube material, such as, for example, a steel tube, ring element portions or ring elements of the width B can be cut off from the tube and then, as described beforehand, can be deformed from their ring-shaped form such that they are fixed on the cable sheath and the ring element portions, also described beforehand, project radially outward from the cable sheath.

It is further advantageous when the reshaped ring element is deformed from a round cross section into a polygonal cross section, preferably a hexagonal cross section.

As a result, it is possible to use particularly suitable crimping tools which provide, as it were, in certain part portions that the ring element achieves a substantially polygonal cross section, whilst in recesses of the crimping tool the aforenamed material doublings and material deformations radially outward are brought about.

It is further advantageous when the cable is overmolded or potted with a plastics material in the region of the ring, after the afore-described reshaping of the ring element has taken place.

In this respect, it is a further aspect of the present invention to propose a plug, which is connected to a cable and has a cable grip, wherein the cable grip is formed from a ring element with a ring-shaped wall, wherein the ring element comprises a polygonal cross section, preferably a hexagonal cross section, and at least one ring element portion, which has been formed from the wall and reshaped, further preferably a plurality of said ring element portions protrude radially outwardly in relation to the cable sheath.

Figure 1A:
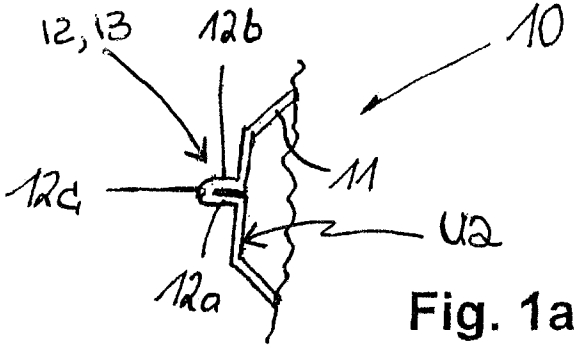
Figure 2:
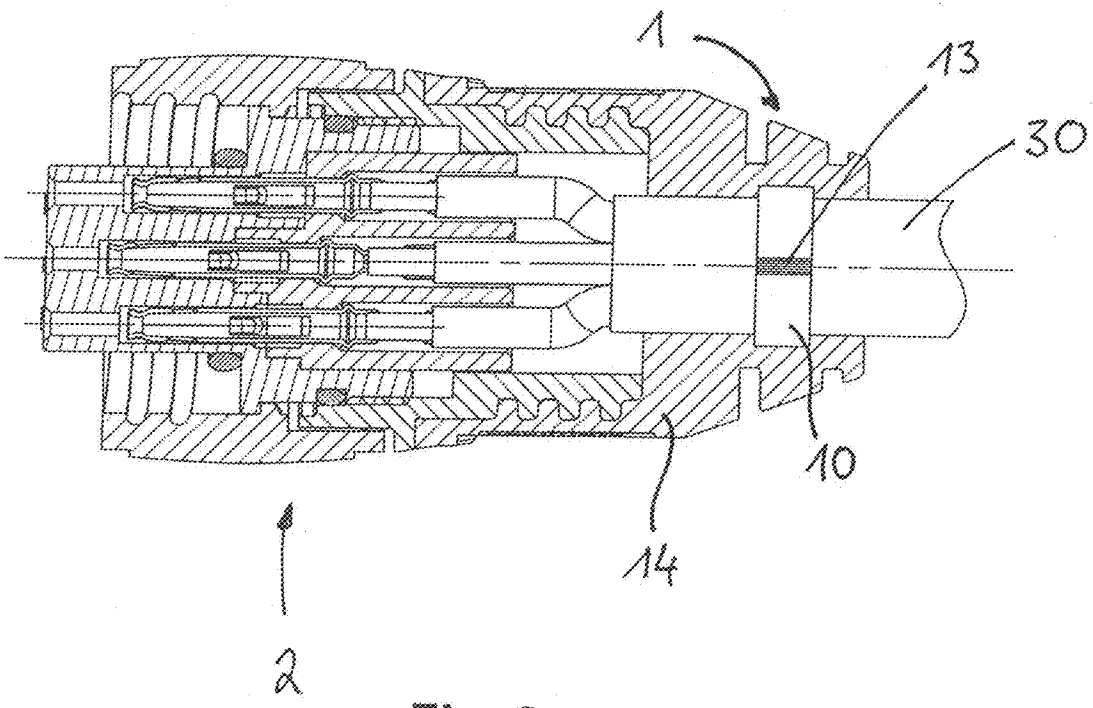

Other advantageous further developments of the invention are characterized in the subclaims or are shown in more detail below together with the description of the preferred realization of the invention by way of the figures, in which:

FIG. 1 shows a perspective view of a plug connection with a cable grip;

FIG. 1*a* shows a detail from FIG. 1;

FIG. 2 shows a sectional view through a plug, similar to the view from FIG. 1, where the cable grip has been overmolded with a plastics material in an injection mold.

The invention is explained in more detail below with reference to FIGS. 1 and 2, identical references pointing to identical functional and/or structural features.

FIG. 1 shows a realization of a cable grip 1 on a plug 2. The plug 2 is connected to a cable 30 with a substantially round cross section with a cable sheath 31. The cable sheath 31 comprises an external circumference U1. As can also be seen, a metal ring element 10 rests on the cable sheath 31 of the cable 30, said metal ring element being formed by a ring-shaped wall 11 with a substantially polygonal, here hexagonal, cross section which has been moved from its original ring form into the form shown with a polygonal cross section.

The internal circumference U2 of the ring element 10 has been reshaped in this respect to a reduced internal circumference. It can additionally be seen that as a consequence of the reshaping, a reshaped ring element portion 13 which was formed from the wall 11 protrudes radially outward in relation to the cable sheath 31.

Not shown explicitly is a second such ring element portion 13, diametrically opposite on the opposite side, which cannot be seen in the perspective view.

The ring element 10 is characterized by the regions 12 characterized as a result of the deforming which show the regions which, for reducing the original internal circumference U2, have consequently been reshaped such that the ring element portions 13, which have been deformed in each case, protrude radially outward in relation to the cable sheath 31.

In the view of a detail next to FIG. 1 it is possible to see in a purely schematic manner how the diameter and consequently the original internal circumference of the ring element 10 has been reduced.

The design of the material doubling, as in a cutout of a detail in FIG. 1*a*, is realized such that the wall portions 12*a*, 12*b* each rest with their inside surfaces flatly on one another and are connected to one another via a bending portion 12*c*.

It can be seen in FIG. 2 how the overmolding of the cable grip 1 is effected around the cable grip 1 and at the same time around the cable sheath 31, parts of the overmolding encompassing the plug 2.

As a result of the specific design of the ring element 10, it is held in the plastic overmolding 14 with its ring element portions 13.

The invention is not restricted in its realization to the preferred exemplary embodiments provided above. Rather, a number of variants are conceivable which use the solution shown even where realizations are fundamentally different.

LIST OF REFERENCES

1 Cable grip
2 Plug
10 Ring element
11 Wall
11*a*, 11*b* Wall portions
12 Region
12*a*, 12*b* Inside surfaces
12*c* Bending portion
13 Ring element portion
14 Plastic overmolding
30 Cable
31 Cable sheath
B Width

The invention claimed is:

1. A method for producing a cable grip of a cable which is to be attached to a plug and has a round cross section and has a cable sheath with an external circumference comprising the steps of:

a) provide a metal ring element which is produced from a ring-shaped wall with a substantially circular cross section, wherein the ring element comprises an internal circumference which is greater than the external circumference of the cable sheath;

b) move the ring element onto the cable sheath of the cable at a defined position; and c) deform the ring element in such a manner that a reduced internal circumference, which is generated as a result of the deformation, is smaller than or equal to the external circumference of the cable sheath such that it is fixed on the cable sheath and, in addition, the wall of the ring element has been reshaped in at least one region to reduce the internal circumference in such a manner that at least one ring element portion, which has been formed by the wall and reshaped, has wall portions with inside surfaces thereof positioned flatly on one another and that are connected to one another via a bending portion, and the at least one ring element portion protrudes radially outward in relation to the cable sheath.

2. The method as claimed in claim 1, wherein, in addition, the ring element has been reshaped as a result of the deformation in multiple regions to reduce the internal circumference such that the in each case deformed ring element portions protrude radially outward in relation to the cable sheath.

3. The method as claimed in claim 1, wherein the internal circumference is greater by approximately between 15% and 40%, than the external circumference of the cable sheath.

4. The method as claimed in claim 1, wherein the ring element is cut off in a desired width from a cylindrical tube material.

5. The method as claimed in claim 1, wherein the reshaped ring element is deformed from a round cross section into a polygonal cross section or a hexagonal cross section.

6. The method as claimed in claim 1, wherein the cable is overmolded or potted with a plastics material in the region of the ring element.

7. A plug which is connected to a cable and has a cable grip, wherein the cable grip is formed from a ring element with a ring-shaped wall, wherein the ring element comprises a polygonal cross section or a hexagonal cross section, and at least one ring element portion, which has been formed from the ring-shaped wall and reshaped, that has wall portions with inside surfaces thereof positioned flatly on one another and that are connected to one another via a bending portion, and the at least one ring element portion protrudes radially outward in relation to the cable sheath.

* * * * *